US011413664B1

(12) United States Patent
Martin et al.

(10) Patent No.: US 11,413,664 B1
(45) Date of Patent: Aug. 16, 2022

(54) WHIP HEAD HAVING FILAMENT-HOLDING PASSAGEWAYS

(71) Applicant: A. W. Perkins Company, Rutland, VT (US)

(72) Inventors: Thomas Martin, Rutland, VT (US); Gregory Newth, Montague, MA (US)

(73) Assignee: A. W. PERKINS COMPANY, Rutland, VT (US)

( * ) Notice: Subject to any disclaimer, the term of this patent is extended or adjusted under 35 U.S.C. 154(b) by 322 days.

(21) Appl. No.: 16/419,701

(22) Filed: May 22, 2019

Related U.S. Application Data

(63) Continuation-in-part of application No. 16/171,319, filed on Oct. 25, 2018.

(51) Int. Cl.
*B08B 9/045* (2006.01)
*B08B 1/00* (2006.01)

(52) U.S. Cl.
CPC ..... *B08B 9/045* (2013.01); *B08B 1/002* (2013.01); *B08B 2209/04* (2013.01)

(58) Field of Classification Search
CPC ..... B08B 9/045; B08B 9/043; B08B 9/0436; B08B 2209/04; B08B 1/002
USPC ..... 15/104.16, 104.2, 104.066
See application file for complete search history.

(56) References Cited

U.S. PATENT DOCUMENTS 1,663,194 A * 3/1928 Denman ..... E21B 37/02 15/104.2
1,970,302 A * 8/1934 Gerhardt ..... B24D 13/10 15/183
5,369,834 A * 12/1994 Groen ..... B08B 5/02 15/104.09
5,745,948 A 5/1998 Lloyd
7,644,465 B1 * 1/2010 Bently ..... A46D 1/00 15/179
2016/0341422 A1 11/2016 Pedersen

* cited by examiner

*Primary Examiner* — Laura C Guidotti
(74) *Attorney, Agent, or Firm* — C. Nessler

(57) ABSTRACT

A whip head tool for cleaning ducts has passageways that hold filaments, such as thermoplastic monofilaments. A straight passageway has a reduced diameter portion which is a choke or pinch point, to deform locally a filament that is pushed through the passageway. A V shape passageway has a choke or pinch point which is the apex, also to deform locally a filament. The ends of a filament extend from the passageway openings and the choking or pinching frictionally holds the filament from flying out of the passageway when the user rotates the tool for use.

18 Claims, 5 Drawing Sheets

WHIP HEAD HAVING FILAMENT-HOLDING PASSAGEWAYS

This application is a continuation in part of U.S. patent application Ser. No. 16/171,319 of Gregory Newth, filed Oct. 25, 2018, the disclosure of which is hereby incorporated by reference.

TECHNICAL FIELD

The present invention relates to devices used for cleaning ducts and conduits, as well as to other devices which have rotating heads from which filaments project and which are used to impact or cut objects in the path of the head.

BACKGROUND

Lint and clinging debris accumulate on the interiors of ducts that are associated with air movement in air conditioning systems. To remove such deposits, it is common for a mechanic to run a tool along the length of the duct from an access point. In general, mechanics use snakes, i.e., flexible light steel or plastic shafts, to push a tool—mostly called here a head—along the length of a duct. In the prior art, different kinds of heads have been used, according to the kind of duct and the nature of deposit.

To clean air ducts it is common to use bristle brushes. A familiar prior art brush comprises light-but-stiff wires or fibers which run radially from where they are captured within a core shaft comprised of heavy dual-spiral of steel wires. The brush may be pushed and pulled axially while being rotated. It also common to use a flail like device which has flexible plastic filaments extending radially, often referred to as a whip head. A device is fastened to the end of a rotating flexible shaft and rotated at a moderate speed while being and pushed down length of a duct.

There are conflicting needs that limit how a whip head can be shaped. Those limitations include that a head should be short in length for maneuverability within a duct and that the body should be sufficiently big to hold the filaments, which are typically made of strong monofilament thermoplastic.

The filament holding means of a whip head has to be adequate to resist the pulling forces applied to a filament due to rotation of the head and frictional engagement of the filament with an object or debris. The filament holding means ought not damage the filament locally and create a fracture initiation site. Heads may be subject to heavy exposure of fine powder debris, and thus any filament holding means should not be adversely affected by such. Filaments wear out and fracture. Thus filaments must be able to be easily replaced, often in inconvenient field situations.

Typically filaments have been held in prior art heads by running them within straight through-holes or into straight blind passageways, where they are held in place by such as set screws or cams. Fine small parts such as screws or cams can be lost during use or when a filament is being replaced. Some prior art filament holding means are very effective but are difficult or costly to fabricate. Thus there is a continuing need for a whip head having a filament-holding means that holds the filament securely, lacks small parts that can be lost, is economical to fabricate, and is functional even when there are dirty field conditions.

SUMMARY

An object of the invention is to provide a tool which is useful as a whip head comprising filaments for cleaning ducts, where the whip head filaments are held in the head without the use of screws, cams or other moveable parts of the head. Another object is to provide a whip head which holds filaments well during use, enables filaments to be inserted and easily replaced, and is economical to manufacture and maintain.

In accordance with the invention a tool comprises a body with plurality of passageways running though the body, where each passageway has two opposing end openings and a choke spaced apart from the openings. A choke is a portion of the passageway which is shaped to deform a filament while still allowing the filament to be pushed through the filament when the filament is installed. In use, a filament of pre-determined length is pushed into one opening, through the choke, and out the other opening. The choke deforms the filament and creates frictional resistance to the filament moving out of the passageway before and during actual use.

In an embodiment of the invention, the passageway is straight and the choke is a reduced bore diameter portion spaced apart from the openings, the portion preferably centered on the midpoint of the passageway length. An exemplary straight passageway lies in a plane which is perpendicular to the central length axis of the body and intersects the central length axis.

In another embodiment, the passageway is V shape and comprised of two legs that run from the surface openings and meet at an apex of the passageway, which apex forms the choke. A V shape passageway may lie in a plane that includes the central length axis of the head, with the included angle of the V shape facing rearwardly. A V shape passageway preferably has equal length legs and an included angle of about 120 to 170 degrees and an apex that intersects the central length axis.

The foregoing and other objects, features and advantages of the present invention will become more apparent from the following description of preferred embodiments and accompanying drawings.

DESCRIPTION

The present invention may be applied to devices and uses as described in U.S. patent application Ser. No. 16/171,319 of Gregory Newth, filed Oct. 25, 2018, the disclosure of which is hereby incorporated by reference.

Figure 1:
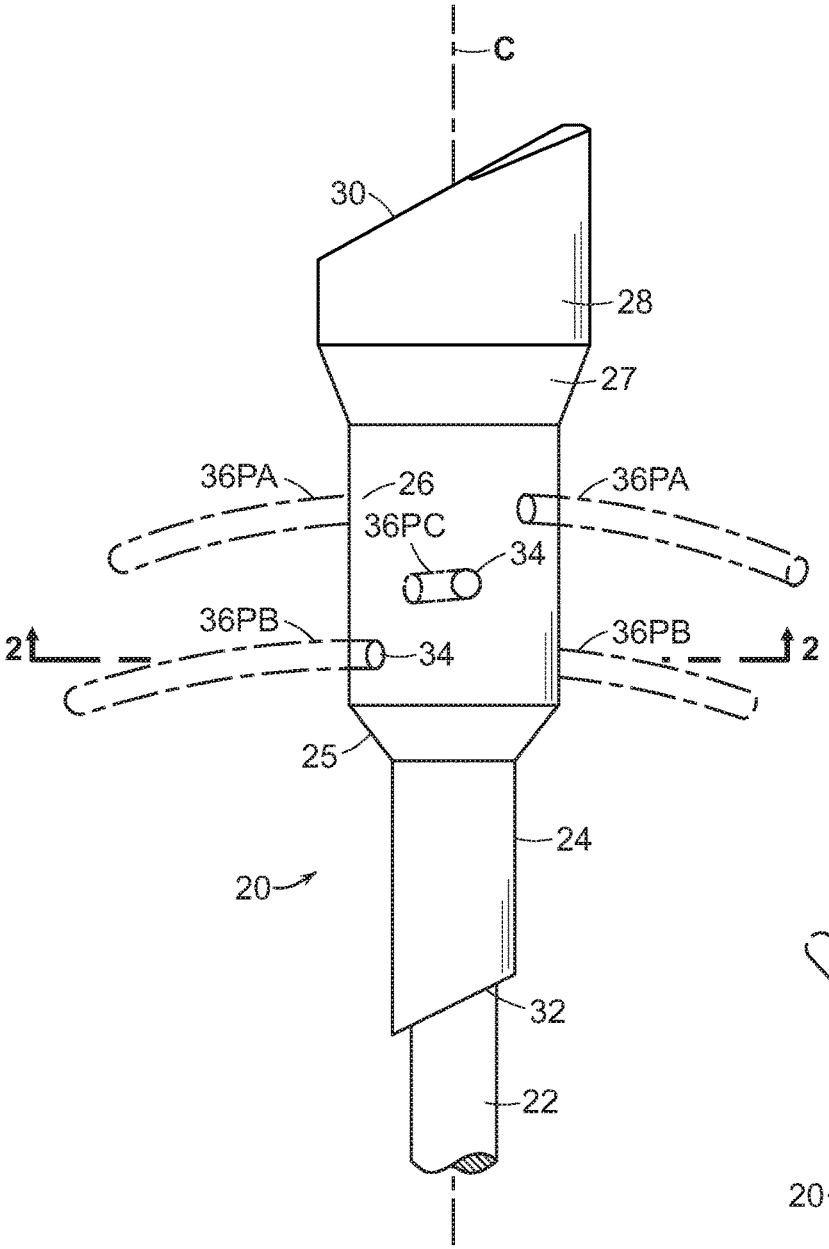
FIG. 1 is a side view of a whip head.
Figure 4:
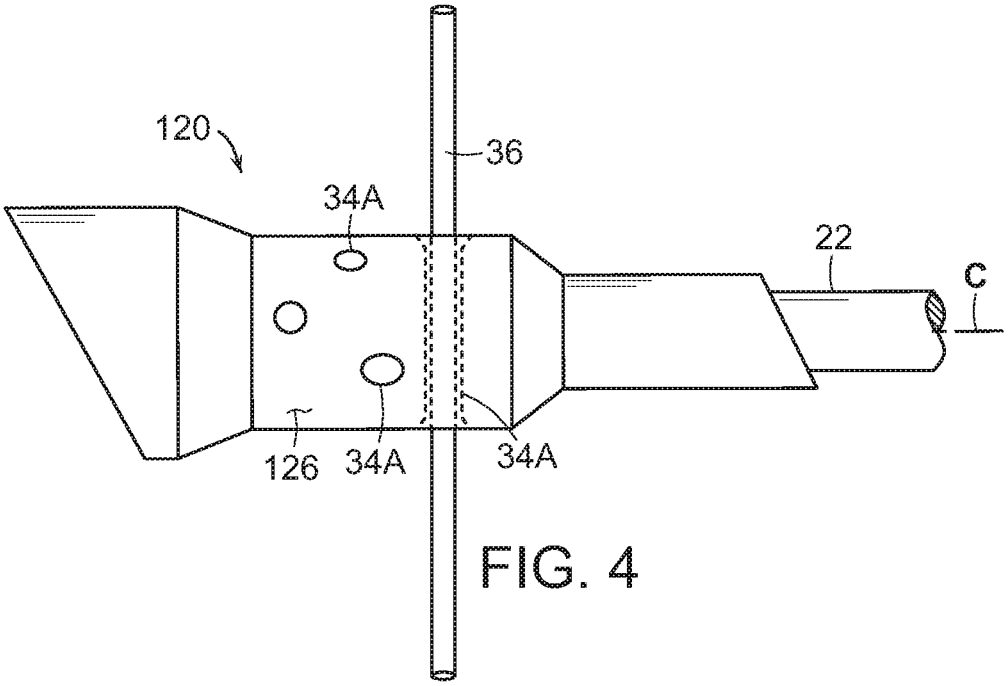
FIG. 4 is a side view like FIG. 1, showing a whip head having a stepped filament passageway that runs transversely to the lengthwise axis of the head.

A tool which comprises the present invention is mostly referred to here as a whip head, sometimes simply as a "head". FIG. 1 and FIG. 4 show in side view a whip head 20 mounted for use on the end of a flexible shaft 22. Whip head 20 comprises shank portion 24, mid-body portion 26, and tip portion 28. The tip is at the distal end of the head (i.e., the upper end of the head as shown in the FIG. 1). Preferably, the three portions 24, 26, 28 are substantially circular as shown; alternatively, they may be non-circular. Conical transition portions 25 and 27 respectively connect the three portions. In the FIG. 1 embodiment the three portions have different diameters. Alternatively, some or all of the portions have the same diameter. The head proximal end comprises shank 24, at the end of which is rake 32, a lengthwise-inclined annular surface. The head distal end or tip 28 has a canted surface comprising rake 30. Head 20 is mounted on the end of shaft 22 and the longitudinal axis C of the head aligns with the length axis of the shaft. Shank 24 has a bore for receiving shaft 22 which is secured to the shank by swaging of the shank or by use of fasteners (not shown) or adhesive.

Figure 2:
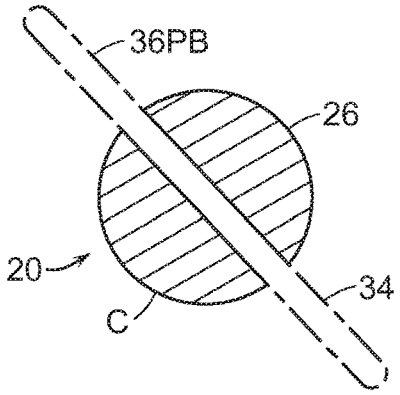
FIG. 2 is a transverse cross section of the whip head of FIG. 1.

The transverse cross section of FIG. 2 shows a typical passageway 34. Each passageway is shaped to receive and to hold a filament by frictional force created by deformation or pinching in the center portion of the passageway.

Filaments are most often thin monofilament plastic fibers of about 0.060 to 0.20 inch (about 1.5 to 5 mm) in diameter. Filaments may also comprise braided stainless steel wires cables. In FIG. 1 filaments 36PA, 36PB are shown in phantom. Typically, on each side of the head the filaments will extend approximately in equal lengths from the openings at the outer surface of the head.

A shaft, sometimes referred to as a rod, is typically a long round cross section member which is commercially available. It may be made of polymer-fiberglass, graphite-epoxy resin, metal, or another material. As an example, for cleaning smaller diameter ducts, a shaft diameter may be one-quarter to seven-eighths inch (about 5 to 22 mm), according to the size of head and associated duct. A shaft used in duct cleaning most often is comprised of a multiplicity of shaft segments joined together end to end by couplers.

Figure 3:
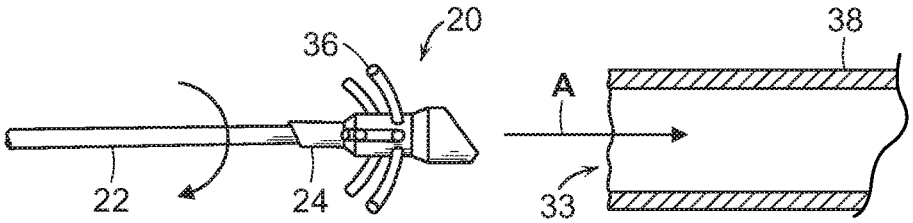
FIG. 3 is a side view of a whip head about to be pushed into a duct, shown in cross section.

FIG. 3 shows by means of arrow A how a whip head 20 may be moved into and along the length of the interior of a circular duct 38, shown in cross section. To clean a duct 38 from an access point opening 33 at the end of the duct, a user (e.g. a mechanic or a technician) pushes on the stiff-but-flexible shaft 22 that is attached to the head 20. While the head is within the duct shaft 22 is simultaneously rotated by a rotary tool/driver (not shown) that is held by or controlled by the user at the access point, as indicated by the curved arrow.

Rotation of head 20 causes the free ends of flexible filaments 36 to extend radially outward due to centrifugal force and to rub and flail the inner wall of the duct, thereby dislodging debris on the wall. Loosened debris can be extracted from the duct by simultaneous or subsequent induced air flow in the duct, typically by a vacuum cleaner or other suction device.

Figure 5:
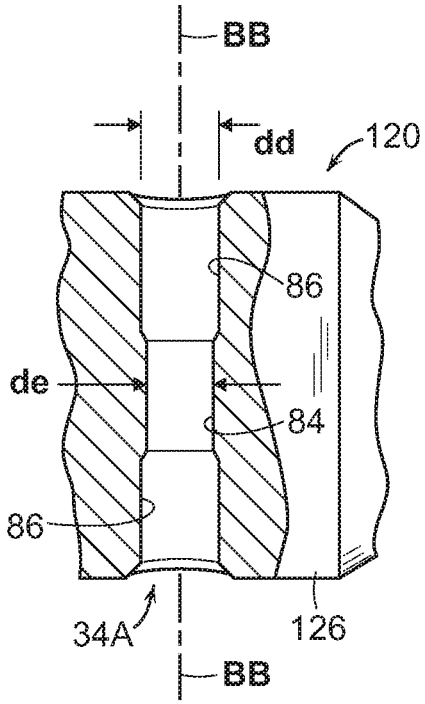
FIG. 5 is a lengthwise plane cross section of a portion of the head of FIG. 4 showing details of the stepped passageway.
Figure 6:
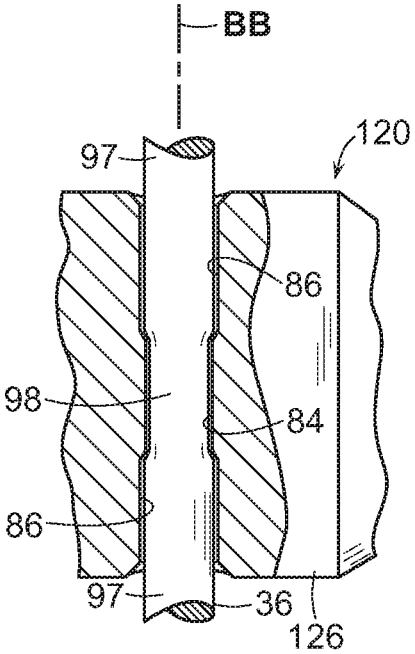
FIG. 6 is a view like FIG. 5 showing how a filament is compressed at the center of the head by the center section of the passageway.

FIG. 4 shows, mounted on a shaft 22, whip head 120, an embodiment of the present invention. Whip head 20 has a plurality of straight passageways 34A in the mid-body portion 126, each shaped to receive and hold a filament. (For simplicity only one filament 36 is shown.) FIG. 5 is a partial cross section through head 120 showing the bore of typical passageway 34A with the filament absent. FIG. 6 is like FIG. 5, but shows how a filament is contained and frictionally held in the passageway where it is deformed or pinched at the choke point.

Each passageway 34A is straight and has a lengthwise axis BB which runs transversely to the lengthwise axis C of the head; i.e., the passageway lies in a plane that is perpendicular to length axis C. In the generality of the invention, a passageway 34A may lie in an inclined plane. Each passageway has a stepped diameter configuration, described below. Each passageway has a small chamfer where the passageway intersects the outside cylindrical surface of the whip head body.

In an exemplary whip head, there are 3 passageways and associated filaments. In other embodiments there may be fewer or more of each. For this and other embodiments described herein, it is preferable to have all passageways in a head configured similarly. Nonetheless, in the generality of carrying out the present invention there may be only one invention passageway, a mixture of invention passageways, of a mixture of invention passageways including a V shape passageway described below and other filament holding means.

Referring again to FIG. 5, the center portion 84 of passageway 34A will have a diameter de that is 0.001-0.002 inch smaller than the nominal outside diameter of an exemplary plastic filament. As described below, the diameter de is slightly less than the diameter dd of the outer portions 86 of the passageway 34A, which extend to the exterior surface of the head. The length of a center portion is preferably about 20 to 40 percent of the passageway length. The center portion is preferably centered on the mid-point of passageway length, but it may be offset from the midpoint in other embodiments, provided it is spaced apart from the end openings of the passageway.

For a head like that shown in FIG. 4, exemplary use may be made of a representative polypropylene filament having a nominal diameter of about 0.100 inch (about 2.5 mm). The hole will have a bore diameter dd of about 0.105 inch in each portion 86, near the exterior surface of the head. The center portion 84 has a reduced diameter de, for instance about 0.098 inch, which is about 93 percent of the bore diameter of adjacent passageway portions. The foregoing kind of filaments and others used in the invention may have an irregular cross section. That is, they may be oblong in cross section or may have small seams or lengthwise extending fins. A diameter for such kinds of filament will be a nominal value. The diameter of a portion 84 for any particular filament shape or type can be determined by reasonable experiment.

The length and bore diameter of the center portion 84 are interrelated. The diameter must be large enough to allow a user to push the filament into the opening and through the whole passageway. If the portion 84 is too small the filament will either not enter or will not be able to be pushed through all the way. Since the amount of friction which must be overcome (and which holds the filament in place) is a function of the length as well as the amount of deformation, if the length of a portion 84 having a particular diameter is too great, the filament will not be able to be pushed through. The bore diameters of the passageway portions which run from the surface opening to the reduced diameter portion 84 are sized so that they do not deform the filament that is pushed through the passageway.

Other diameters of filament may be used. Filaments may be made of other materials known for making string, rope and light cable, including stranded steel wire cable, leather strips or strands, cotton and other stranded fiber materials.

The end of a filament can be positioned in an invention whip head by running the filament end lengthwise through the passageway portion 86. And then, with more force, the filament can be forced through the middle portion 84, causing the end to move through the opposing side larger diameter outer portion, typically until the filament extends in equal lengths from both sides of the whip head. As a filament passes through the smaller passageway center portion 86, and when it becomes stationary there, the filament will in the diametrical dimension be deformed.

FIG. 6 shows a filament with the center portion of the filament compressed by the center portion of the body passageway. The resiliency of the compressed filament portion, as it "wants to expand", generates a frictional force on the filament within the passageway 86, sufficient to resist forces that would pull it out or make it fly out of the passageway. For replacement, the user exerts sufficient force to overcome the frictional force, and pulls the filament out of the head. It is believed that during use of a whip head a filament of a resilient material/structure has a substantial bend at a passageway exit because the whip head is rotating, and especially if the filament ends are hitting an object. That bending creates substantial friction between the filament and the head, to resist pulling of a filament from a passageway. In this context, deformation within the passageway achieved by the invention is satisfactory.

Passageways of the present and other embodiments of heads described herein are preferably formed by drilling into a head made of a metal such as steel, brass, or light metal. Thus the passageway will have a circular cross section. In the generality of the invention, passageways may not be perfectly round, while still having a cross sectional area and angling (as applies) which is comparable to passageways which are round and are described herein.

Figure 7:
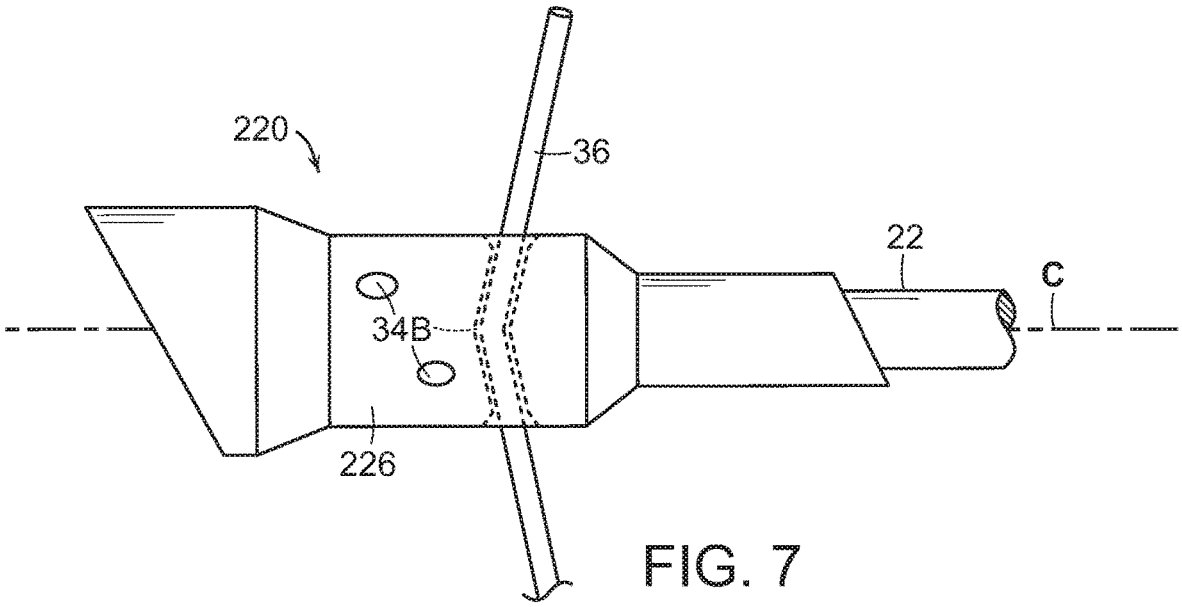
FIG. 7 shows in side view a whip head having a filament passageway runs transversely on a V shape path through the head.
Figure 8:
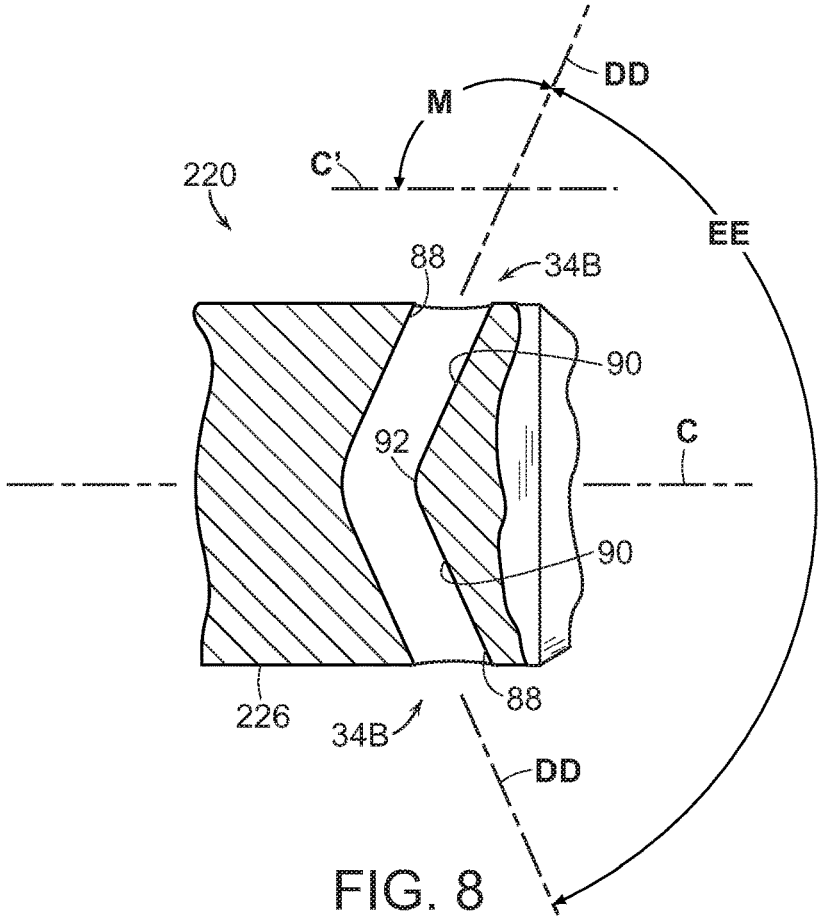
FIG. 8 is a lengthwise plane cross section of a portion of the head of FIG. 6 showing details of the V shape passageway.

FIG. 7 shows an embodiment of whip head 220, the V shape passageway configuration of which also compresses the filament within the head. Head 220 and has three passageways 34B in mid-body portion. Again, only one filament 36 is shown within a passageway, for simplicity of illustration. FIG. 8 is a lengthwise cross section of body portion 226 of head 220.

Referring to FIG. 8, an exemplary passageway 34B comprises two portions, namely legs 90 that run from openings 88 on the exterior surface of the mid-body portion 226 of head 120. The legs 90 each have center axes DD that run at an angle M to length axis C, as indicated by reference to a displaced length axis C' in the Figure. The intersecting bores of legs 90 meet at apex 92 at the nominal radial center of the head. Preferably, angle M is in the range about 95 degrees to about 120 degrees, more preferably about 105 degrees. The related included angle EE between the passageways is between about 120 degrees and about 170 degrees, preferably about 150 degrees. If the included angle EE is substantially greater than the foregoing range, it is unacceptably difficult to insert a filament pushing it through the passageway because there is too much "pinch" at the passageway apex. If the included angle EE is substantially less than the foregoing range, a filament will have unacceptably too low deformation (pinching) in vicinity of the apex and the filament will not be sufficiently secured within the passageway, to resist forces pulling it out.

Exemplary head 220 has three passageways 34B; other embodiments may fewer or more of passageways 34B. In other embodiments, all passageways need not have the same angling. In other embodiments of the invention, the V shape may be non-symmetrical relative to the centerline of the head. For example, one leg may run at angle M of 95 degrees, the other at 120 degrees, for an included angle EE of 145 degrees.

When a user installs a filament by pushing the end of a filament axially into one end of the passageway, the user encounters and overcomes resistance as the filament end passes by the apex 92 where the leg portions 90 intersect at angle EE. The legs of a preferred passageway are round in cross section and have constant diameter along each leg length. Non-round legs might be used. Passageway legs which have somewhat changing diameter along the leg length may be used. For example, there may be an increased diameter or taper in proximity to the surface opening.

Figure 9:
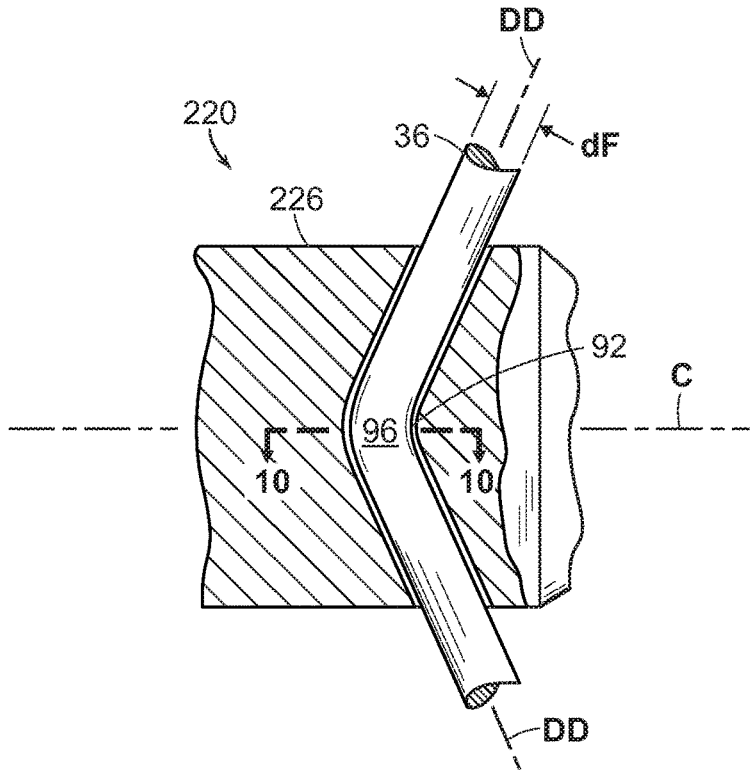
FIG. 9 is a view like FIG. 8 showing how a filament is compressed at the center of the head by the shaping of the V shape passageway.
Figure 10:
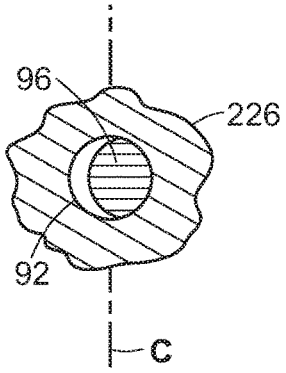
FIG. 10 is a fragmentary lengthwise cross section showing a filament within a V shape passageway of a whip head.

FIG. 9 is a lengthwise cross section like FIG. 8, with a filament now in place. FIG. 10 is a fragmentary view of a lengthwise-plane cross section at 90 degrees to the cross section of FIG. 9.

FIG. 10 together with FIG. 9 show how filament 36 is deformed at the apex 92 of the intersection of the two opposing legs 90 of the V shape passageway. For example, a filament round cross section shape may be changed to one that is a flattened oblong. Or there may deformation of fins or other lengthwise running raised portions, such as when a filament has a nominally polygon cross section shape or comprises small lengthwise running ribs. A bending, pinching, flattening and deforming force, as applied to a particular character of filament, at the locale of apex 92 creates friction and resistance to movement of the filament within the passageway. The bore diameters of the passageway portions which run from the surface opening to the apex region 92 are sized so that they do not deform a filament that is pushed through the passageway.

The passageways of the embodiments of FIG. 7 to FIG. 10 are angled in a lengthwise plane of the central length axis C and the included angles all face in the same direction, namely toward the rear of the head. Optionally one or all passageways may face in the forward direction instead of rearwardly as shown.

Figure 11:
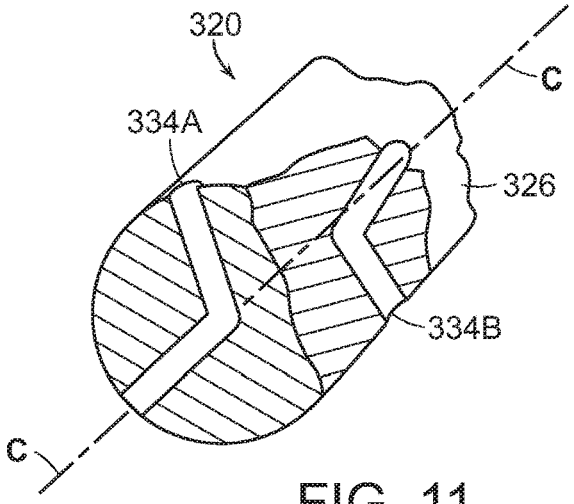
FIG. 11 is a perspective partial cross section of a portion of a head having passageways that lie in a plane perpendicular to the length axis.
Figure 12:
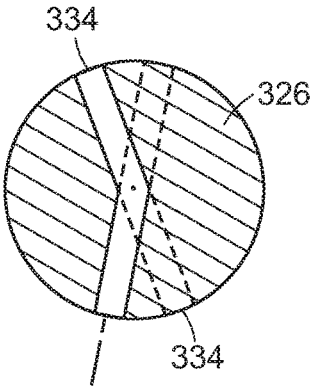
FIG. 12 is an end cross section view of the head shown in FIG. 11.

FIG. 11 is a perspective partial cross section of a portion of body 326 of head 320 and FIG. 12 is an end cross section of body 326. Body 326 has passageways 334A, 334B each having both legs lying in a plane which is perpendicular to the length axis C, with each passageway apex lying along the length axis C. The legs of one passageway 334A face in opposing direction to the legs of the other passageway 334B. In another embodiment not shown, passageways 334A, 334B may face in the same direction. There may be further passageways.

Figure 13:
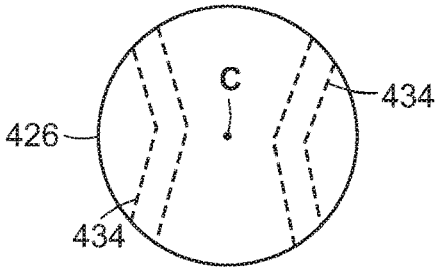
FIG. 13 is an end view of a head where the apexes of the passageways are not on the centerline of the head.

FIG. 13 is an end view of a body 426 which has two passageways 434, the apexes of which are spaced apart from the centerline (length axis C). In another embodiment not pictured, each passageway 434 will be oriented so the passageway angle faces toward axis C rather than away, as in FIG. 11.

Figure 14:
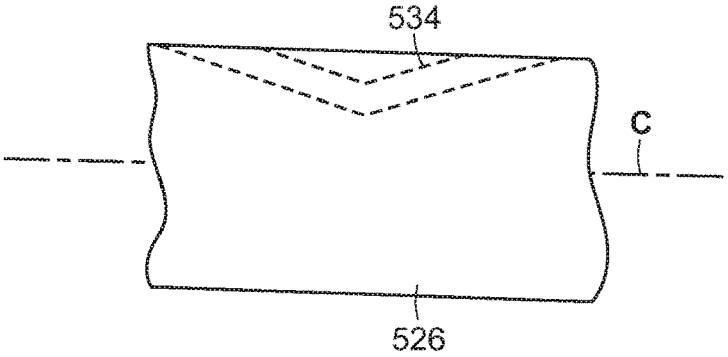
FIG. 14 is a side view of a portion of a head having passageways lying in a lengthwise plane.

FIG. 14 shows a lengthwise portion of an embodiment of head body 526 where the passageway 534 lies within a lengthwise plane of the center axis C.

Where the passageways pictured lie in planes which include two orthogonal axes of a body, passageways which line in offset or inclined planes may be used. In all of the embodiments shown, there may be fewer or more passageways than described. An invention head may comprise a mixture of the passageway embodiments described above, and may include prior art passageways.

The invention achieves the objects of the invention. A filament is held within a whip head by a single piece body construction which is free of any moving internal parts, such as screws or cams, which press against the filament to hold it. Thus there are no small parts which might be lost.

Whip heads of the present invention may have other uses than in cleaning ducts; for example, a head may be used in the same manner as a rotating wire brush. The body of a whip head may have a shape other than round, as shown; for example, the body may have a hexagonal shape. The invention may find use in other rotating objects than whip heads when filaments need to be easily changed and small parts such as screws and cams are to be avoided.

The invention, with explicit and implicit variations and advantages, has been described and illustrated with respect to several embodiments. Those embodiments should be considered illustrative and not restrictive. Any use of words such as "preferred" and variations suggest a feature or combination which is desirable but which is not necessarily mandatory. Thus embodiments lacking any such preferred feature or combination may be within the scope of the claims which follow. Persons skilled in the art may make various changes in form and detail of the invention embodiments which are described, without departing from the spirit and scope of the claimed invention.

What is claimed is:

1. A tool adapted for use as a whip head comprising:

a one-piece body having a length, a central length axis, a shank portion configured for attachment to a shaft for rotating the tool about said central length axis, an exterior surface, and a plurality of passageways running within the body, each passageway having a first end opening and an opposing second end opening, wherein said end openings spaced apart from each other on said exterior surface;

each passageway having a bore diameter, and a choke spaced apart from each said end opening;

each passageway shaped for receiving by lengthwise thrusting there-through a resilient filament, the filament being deformed within the choke.

2. The tool of claim 1 wherein each passageway and the choke thereof run through said central length axis of the body.

3. The tool of claim 1 wherein each passageway lies in a plane which runs transversely to the central length axis.

4. The tool of claim 1 further comprising: a plurality of filaments, each filament running through a passageway of said plurality of passageways, each filament having opposing ends extending outwardly from said end openings at said body exterior surface, and each filament comprising a portion that is deformed at the location of said choke and thereby made resistive to lengthwise motion within the passageway; and, a shaft connected to said shank portion.

5. A method of cleaning a duct which comprises:

providing a tool of claim 4; and, rotating said shaft and thereby said tool about said central length axis while moving the tool lengthwise within a duct, so the filaments rotatingly contact an interior surface of the duct, thereby to remove debris from said interior surface.

6. The tool of claim 1 wherein each passageway is straight and wherein the choke is a portion of the passageway that has a bore diameter which is smaller than other portions of the passageway.

7. The tool of claim 6 wherein said choke is a portion of the passageway having a diameter which is about 1 to 2 percent less than the bore diameter of adjacent portions of the passageway.

8. The tool of claim 7 wherein the length of said choke portion is 20 to 40 percent of the length of the passageway.

9. The tool of claim 6 wherein the length of said choke is 20 to 40 percent of the length of the passageway.

10. A method of cleaning a duct which comprises:

providing a tool in accord with claim 1;

pushing a filament into and through each passageway so that portions of the filament extend from both said end openings, wherein the portion of the filament that is within the choke is deformed and the other portions of the filament are not deformed; and, rotating said tool about the central length axis while moving the tool lengthwise within a duct, so the filaments rotatingly contact an interior surface of the duct, thereby to remove debris from said interior surface.

11. A tool adapted for use as a whip head comprising a body having a length, a central length axis, a shank portion configured for attachment to a shaft for rotating the tool about said central length axis, an exterior surface, and a plurality of passageways running within the body, each passageway having a first end opening and a second end opening, the end openings spaced apart on said exterior surface, a bore diameter, and a choke positioned between said end openings and spaced apart from each said end opening;

wherein each passageway is shaped for receiving a filament that is inserted lengthwise into the one of said end openings and is then pushed lengthwise through the passageway; wherein each passageway is V shape and is comprised of two legs that meet at a passageway apex, which apex comprises said choke.

12. The tool of claim 11 wherein each V shape passageway has an included angle of about 120 to about 170 degrees between the legs.

13. The tool of claim 12 wherein the included angle is about 150 degrees.

14. The tool of claim 11 wherein the lengths of the legs are equal to each other.

15. The tool of claim 11 wherein apex of each passageway lies along the central length axis.

16. The tool of claim 11 wherein each passageway lies in a plane that is nominally perpendicular to the length axis and wherein the apex is offset from the central length axis.

17. The tool of claim 11 wherein each passageway lies in a plane that is parallel to the central length axis.

18. A method of cleaning a duct which comprises:

providing a tool in accord with claim 11;

pushing a filament into and through each passageway so that portions of the filament extend from both said end openings, wherein the portion of the filament that is within the choke is deformed and the other portions of the filament are not deformed; and, rotating said tool about the central length axis while moving the tool lengthwise within a duct, so the filaments rotatingly contact an interior surface of the duct, thereby to remove debris from said interior surface.

* * * * *